US006021631A

United States Patent [19]

Prechtel

[11] Patent Number: 6,021,631

[45] Date of Patent: Feb. 8, 2000

[54] INTEGRATED DOUBLING AND TWISTING METHOD AND THREE-FOR-ONE TWISTING SPINDLE

[75] Inventor: Michael Prechtel, Constance, Germany

[73] Assignee: Hamel AG, Germany

[21] Appl. No.: 09/106,963

[22] Filed: Jun. 29, 1998

[30] Foreign Application Priority Data

Jun. 28, 1997 [DE] Germany ..... 197 27 609

[51] Int. Cl.[7] ..... D01H 1/10

[52] U.S. Cl. ..... 57/58.49; 57/58.52; 57/58.83; 57/354

[58] Field of Search ..... 57/58.49, 58.52, 57/58.61, 58.7, 58.83, 354

[56] References Cited

U.S. PATENT DOCUMENTS

| | | | |
|---|---|---|---|
| 3,402,545 | 9/1968 | Nimtz et al. | 57/58.49 |
| 4,439,979 | 4/1984 | Winkelmann | 57/58.86 |
| 4,542,618 | 9/1985 | Lossa | 57/58.83 |
| 4,711,081 | 12/1987 | Frentzel-Beyme et al. | 57/279 |
| 5,167,112 | 12/1992 | Stenmans | 57/58.52 |
| 5,220,777 | 6/1993 | Badiali et al. | 57/279 |
| 5,497,607 | 3/1996 | Branson | 57/58.82 |
| 5,515,671 | 5/1996 | Dur | 57/58.83 |

FOREIGN PATENT DOCUMENTS

| | | | |
|---|---|---|---|
| 350303864 | 8/1986 | Germany | 57/58.49 |
| 3503864 | 8/1986 | Germany | 57/58.49 |
| 3711799 | 10/1987 | Germany . | |

*Primary Examiner*—William Stryjewski
*Attorney, Agent, or Firm*—Robert W. Becker & Associates

[57] ABSTRACT

An integrated doubling and twisting method includes the step of arranging at least two supply bobbins coaxially above one another in a protective pot of a bobbin support. The at least two supply bobbins are connected to one another, and the bobbin support together with the at least two supply bobbins is rotated. The individual spun yarns from the bobbin supports are removed in the direction of the axis of rotation of the bobbin support. One of the individual spun yarns is removed in clockwise direction and another one of the individual yarns is removed in counterclockwise direction. This feature can also be applied to a method in which a balloon limiter is provided and the individual yarns are guided through a hollow spindle axle.

1 Claim, 5 Drawing Sheets

INTEGRATED DOUBLING AND TWISTING METHOD AND THREE-FOR-ONE TWISTING SPINDLE

BACKGROUND OF THE INVENTION

In the operation of twisting spindles, especially also multi-twisting spindles, it is conventional to wind in a preparatory doubling process at least two individual yarns which are removed from supply bobbins by placing them parallel to one another and winding them onto a cross-wound bobbin. Special care must be taken in this process in regard to a uniform removal of the two individual yarns from the supply bobbins, i.e., care must be taken that the yarns will enter the doubling process with the same tension and length whereby loop formation of the individual yarns must be prevented. A loop will result when one of the two individual yarns has extra length.

In another method, the doubling process is performed on the spindle itself before the actual twisting process takes place. Two single spun yarns are supplied as supply bobbins in a two-for-one twisting spindle. In this method it is also very important to maintain the same tension and length of the two individual spun yarns and to prevent the introduction of loops into the doubling process in order to produce a twisted yarn of high quality.

In three-for-one twisting spindles, as, for example, disclosed in German patent application 35 03 864, the protective pot, respectively, the bobbin support for the supply bobbin is also rotated counter to the rotational direction of the spindle so that upon removal of the yarns from the supply bobbins a removal balloon and thus a tension and length compensation in the yarn is provided which is especially important when using two or more yarns for producing a uniform twisted yarn. Because the supply bobbins rotate very quickly with the bobbin support and the formation of a balloon of the individual yarns, the doubled yarns are stretched so that they have the same length when subjected to the twisting process. With this arrangement, the otherwise required brake within the hollow spindle axle, as is conventional in two-for-one twisting spindles, is no longer necessary because the yarns in the removal balloon coming from the supply bobbins have the desired length and desired tension.

In a pot twisting spindle disclosed in German patent 37 11 799 for twisting one or more yarns, which are supplied by supply bobbins individually or doubled, the supply bobbins inserted into the bobbin support rotate with a slight rolling movement together with the bobbin support, thus positively effecting the removal of the individual spun yarn from the respective bobbin supply and also maintaining the desired tension and length of the two individual yarns.

It is an object of the present invention to design a method of the aforementioned kind such that the supply bobbins substantially rotate together with the bobbin support so that substantially an uninterrupted introduction of the two or more individual spun yarns coming from the supply bobbins into the initial formation zone of the twisted yarn is ensured.

SUMMARY OF THE INVENTION

The present invention relates to a first integrated doubling and twisting method that includes the steps of:

arranging at least two supply bobbins coaxially above one another in a protective pot of a bobbin support;

connecting the at least two supply bobbins to one another;

rotating the bobbin support together with the at least two supply bobbins;

removing individual spun yarns from the at least two supply bobbins in the direction of the axis of rotation of the bobbin support, wherein one of the individual spun yarns is removed in clockwise direction and another one of the individual spun yarns is removed in counterclockwise direction;

guiding the individual spun yarns through a guide eye, positioned on the axis of rotation, to a winding device.

The present invention also relates to a second integrated doubling and twisting method including the following steps;

arranging at least two supply bobbins coaxially above one another in a protective pot of a bobbin support, wherein the bobbin support is surrounded by a balloon limiter and has a hollow spindle axle extending therethrough;

connecting the at least two supply bobbins to one another;

rotating the bobbin support together with the at least two supply bobbins and rotating the balloon limiter in opposite direction;

removing individual spun yarns from the at least two supply bobbins in a direction of an axis of rotation of the bobbin support, wherein one of the individual spun yarns is removed in clockwise direction and another one of the individual spun yarns is removed in counterclockwise direction;

guiding the individual spun yarns together through the hollow spindle axle, a radially extending yarn guide channel, and a gap between the balloon limiter and the protective pot to a winding device.

The two methods have a common feature in that the individual spun yarns coming from the individual supply bobbins are removed in opposite directions, i.e., from one supply bobbin the yarn is removed in the p direction and from the other supply bobbin in the q direction. According to conventional definition, this means that in a plan view onto the end face of the spindle, the p direction of the removed yarn is the clockwise direction and in the q removal direction of the yarn is the counterclockwise direction.

The importance of this measure can be appreciated in connection with the rotational direction in the spun yarn (Z or S rotational direction) and the p or q removal of the spun yarn from the spool.

The Z-spun yarn requires a p removal direction, i.e., yarn removal in clockwise direction. This can be explained as follows.

In order to open a Z-spun yarn, it must rotated to the right, i.e., in a clockwise direction. The same rotational direction is imparted on a yarn removed from a bobbin in the p removal direction when it rolls along the bobbin periphery in order to be subsequently guided to a removal eye which is centrally arranged above the upright bobbin body. During this rolling movement, the spun yarn will also open. The projecting fibers at the bobbin periphery of the remaining yarn thus face an opening rotational gap of the yarn so that no clamping of these projecting fibers in the twisted structure of the spun yarn will result. However, when the Z-spun yarn would be removed in the q direction, i.e., counterclockwise, it would be further rotated in the same direction as the spinning direction upon rolling along the periphery of the bobbin. This would result in the projecting fibers possibly being caught within the now closing rotational gap of the spun yarn which, depending on the strength of the individual yarns, could result in a great impairment of the rolling movement and even could result in yarn breakage.

With respect to the inventive solution, this means that the yarns removed from the supply bobbin that rotates with the bobbin support no longer come into contact with the periphery of the bobbin in a rolling sense. Due to the centrifugal force the yarns lift off the individual bobbins very quickly from their initial contact point and spontaneously contact the inner wall of the rotating bobbin support pot. This is different from the above discussion in regard to yarns rolling along the bobbin periphery.

Depending on the respective initial method steps (winding, spooling), both supply bobbins have different diameters. This results in the yarns removed from the supply bobbins passing one another within the interior of the pot. The yarn removed from the supply bobbin having a smaller diameter will pass the other yarn in a ratio corresponding to the diameter difference of the supply bobbins. When the diameter differences are very small, the parallel and adjacent movement of both yarns at the inner wall of the rotating spool pot will take a longer period of time. This increases the risk that the projecting fibers of either yarn could become clamped in the rotational gap of the spun material of the other yarn. This can happen even when the yarns of both supply bobbins are removed with the correct removal direction with regard to the rotational direction of the spun yarn (S or Z). The parallel residence time of both yarns along the inner wall of the support pot thus determines the risk of yarn breakage.

This undesirable effect is prevented by the inventively suggested removal orientation, respectively, removal arrangement (P and Q). For different bobbin diameters the removed yarns entering the hollow spindle axle will cross one another since one of the yarns is removed in the clockwise direction and the other one is removed in the opposite direction. The risk of projecting fibers getting caught in the gap of the other spun yarn thus is much reduced because of the momentary crossing of the yarns, and this is so even though out of the two yarns is opened due to the wrong removal direction (p or q) acting counter to the spinning direction.

The present invention also relates to a three-for-one twisting spindle that is characterized by:

- a twisting pot comprising a pot bottom having a radial yarn guide channel;
- a hollow spindle axle connected to a radially inner end of the yarn guide channel;
- the twisting pot further comprising a pot wall connected to the pot bottom;
- a rotatably driven bobbin support rotatably mounted on the hollow spindle axle;
- the bobbin support comprised of a support bottom and a protective pot;
- the hollow spindle axle comprised of separate axle parts;
- the protective pot comprised of two portions having different diameters and a radial support flange connecting the two portions.

Since the protective pot has a radial support flange for the upper supply bobbin by being embodied of two portions having different diameters, and by providing the hollow spindle axle in two separate axle parts, between the two portions of the protective pot a free space results to allow the yarn of the lower supply bobbin to be introduced into the lower axle part of the hollow spindle axle without obstruction, while the yarn of the upper supply bobbin can be introduced into the upper end of the hollow spindle axle that is embodied as a yarn inlet tube.

In this manner it is achieved that the two yarns removed from the supply bobbins will not pass one another and will not cross one another.

In order to provide a fixed connection of the supply bobbins arranged coaxially above one another, the two facing flanges of the supply bobbins can be connected by a pin connection. A fixed connection can also be provided by respective receiving elements between the hub part of the bobbin support and the inner mantle of the sleeve bore of the bobbin. A magnetic coupling between the two flanges of the supply bobbins is also possible.

BRIEF DESCRIPTION OF THE DRAWINGS

The object and advantages of the present invention will appear more clearly from the following specification in conjunction with accompanying drawings, in which.

DESCRIPTION OF PREFERRED EMBODIMENTS

The present invention will now be described in detail with the aid of several specific embodiments utilizing FIGS. 1 through 3.

Figure 1:
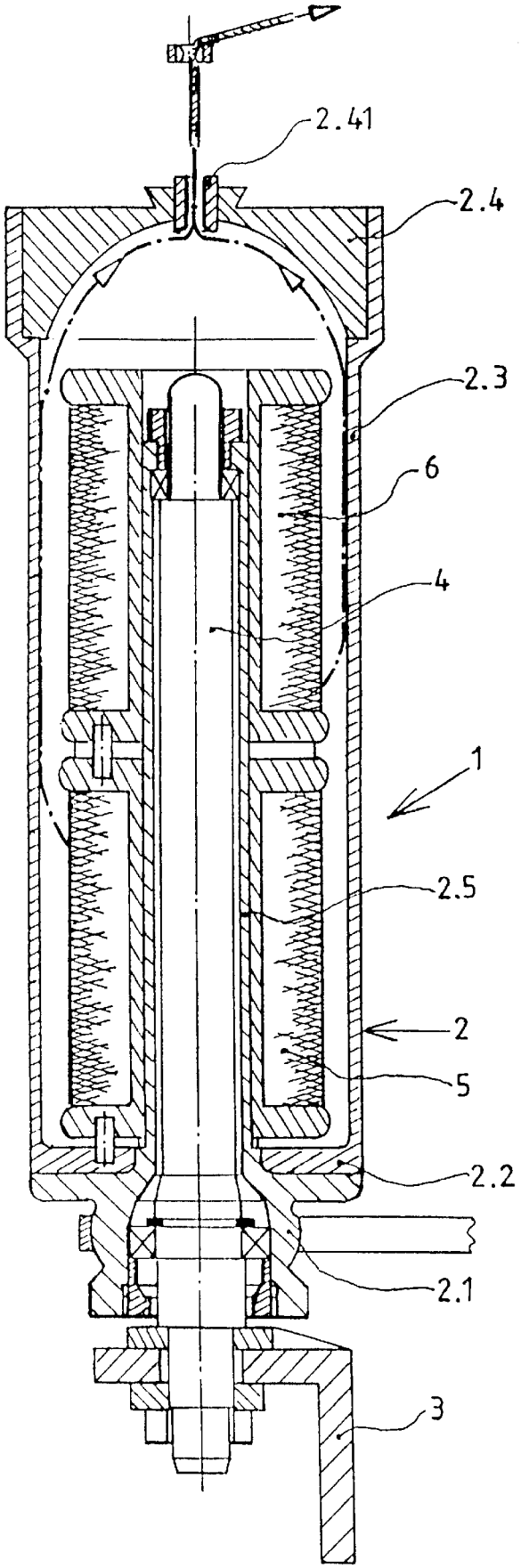
FIG. 1 shows in a schematic representation a sectional view of a pot twisting spindle with rotating bobbin support having a protective pot illustrating the p and q removal directions.
Figure 1A:
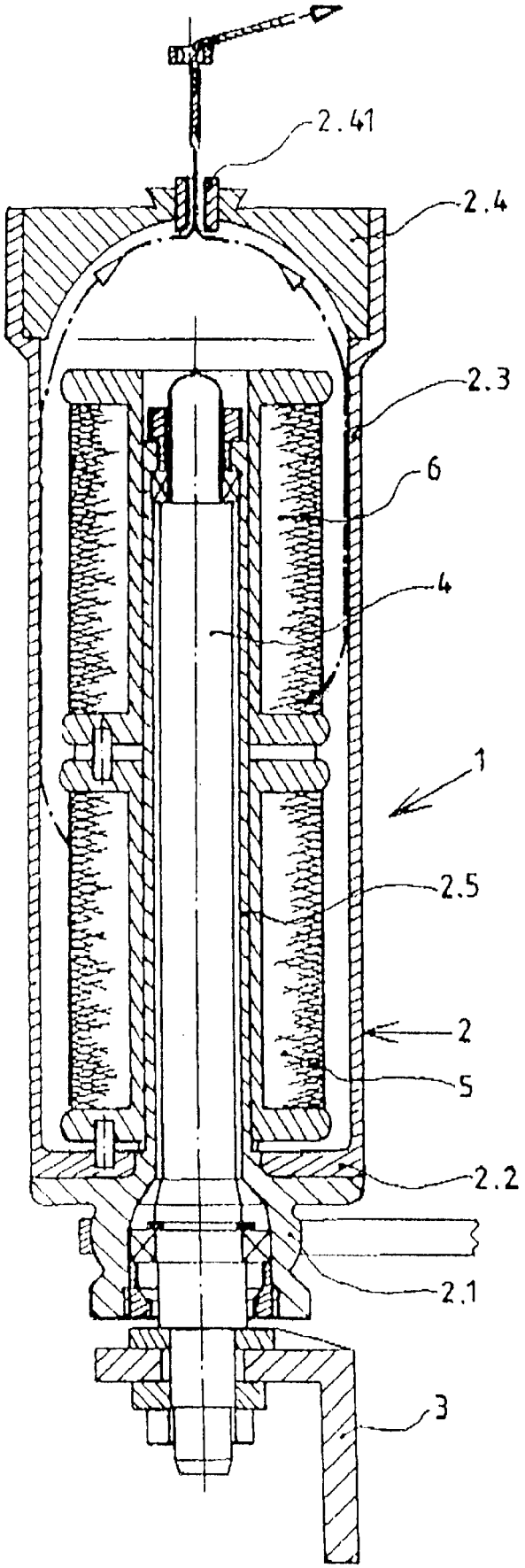
FIG. 1*a* shows the removal direction of the individual yarns.

The twisting spindle 1 represented in FIG. 1 comprises a bobbin support 2 comprised of a spindle whorl 2.1, a spool support bottom 2.2, a bobbin support protective pot 2.3, and a bobbin support cover 2.4 which has a yarn guide eye 2.41 positioned on the axis of rotation of the bobbin support. The bobbin support 2 is supported on a spindle shaft 4 that is secured in a spindle bank 3 and preferably is arranged within a stationary non-represented protective housing. Two supply bobbins 5 and 6 are placed so as to be coaxially stacked onto the elongate bobbin support hub 2.5. The supply bobbins 5 and 6 are connected to one another as well as to the bobbin support 2.

The individual yarns of the two supply bobbins 5 and 6 are removed overhead, i.e., axially in the upward direction and are guided through the central yarn guide eye 2.41 to a non-represented winding device. Due to the rotation of the bobbin support and of the two supply bobbins, the removed individual spun yarns are subjected in the aforementioned manner to a centrifugal force so that this ensures substantially identical yarn tension.

FIG. 1 shows that the yarn is removed from the lower supply bobbin 5 in the p removal direction, i.e., in the clockwise direction, while the yarn of the upper supply bobbin 6 is removed in the q direction, i.e., counterclockwise.

Figure 2:
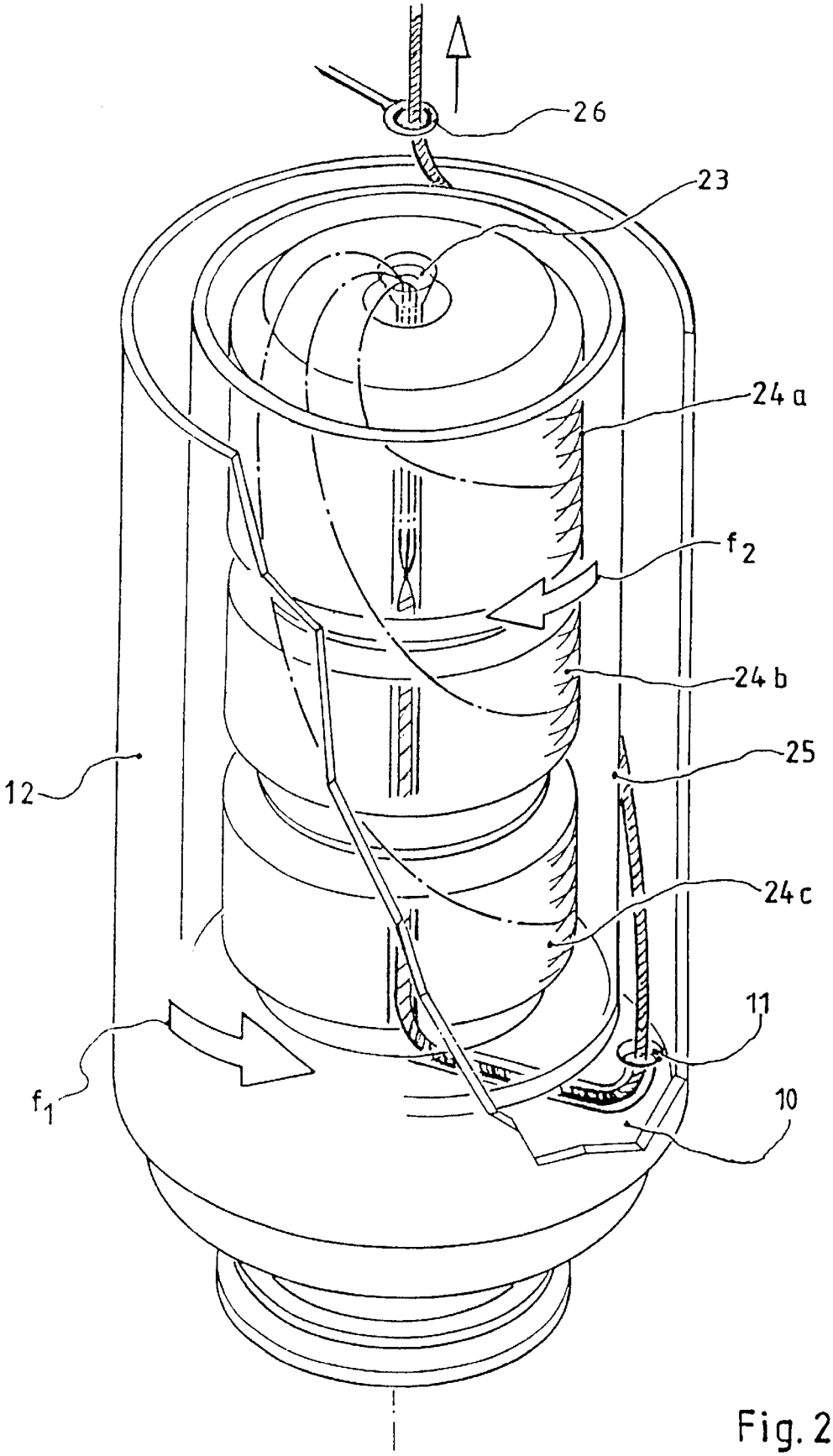
FIG. 2 shows partly in section and partly in a perspective view a three-for-one twisting spindle with three supply bobbins arranged coaxially above one another and fixedly connected to one another.

In the three-for-one twisting spindle represented schematically in FIG. 2, three supply bobbins 24*a*, 24*b* and 24*c* are arranged coaxially above one another and are connected to one another as well as to the bobbin support having a protective pot 25. The bobbin support rotates in the direction indicated by arrow f2 counter to the direction of rotation f1 of the balloon limiter 12. The individual yarns removed from the supply bobbins 24*a*, 24*b*, and 24*c* are guided through the hollow spindle axle represented by the yarn inlet 23, through the radially extending yarn guide channel connected to the hollow spindle axial and provided within the rotor disc 10 connected to the balloon limiter 12, through the outlet opening 11 arranged at the rotor disc 10, through the gap between the protective pot 25 and the balloon limiter 12, and through the guide eye 26 onto a non-represented winding device.

The system represented in FIG. 2 can be used for producing a combined twisted yarn by supplying on the two supply bobbins 24*b* and 24*c* individual strands of a staple fiber yarn and on the supply bobbin 24*a* a filament yarn.

Figure 2A:
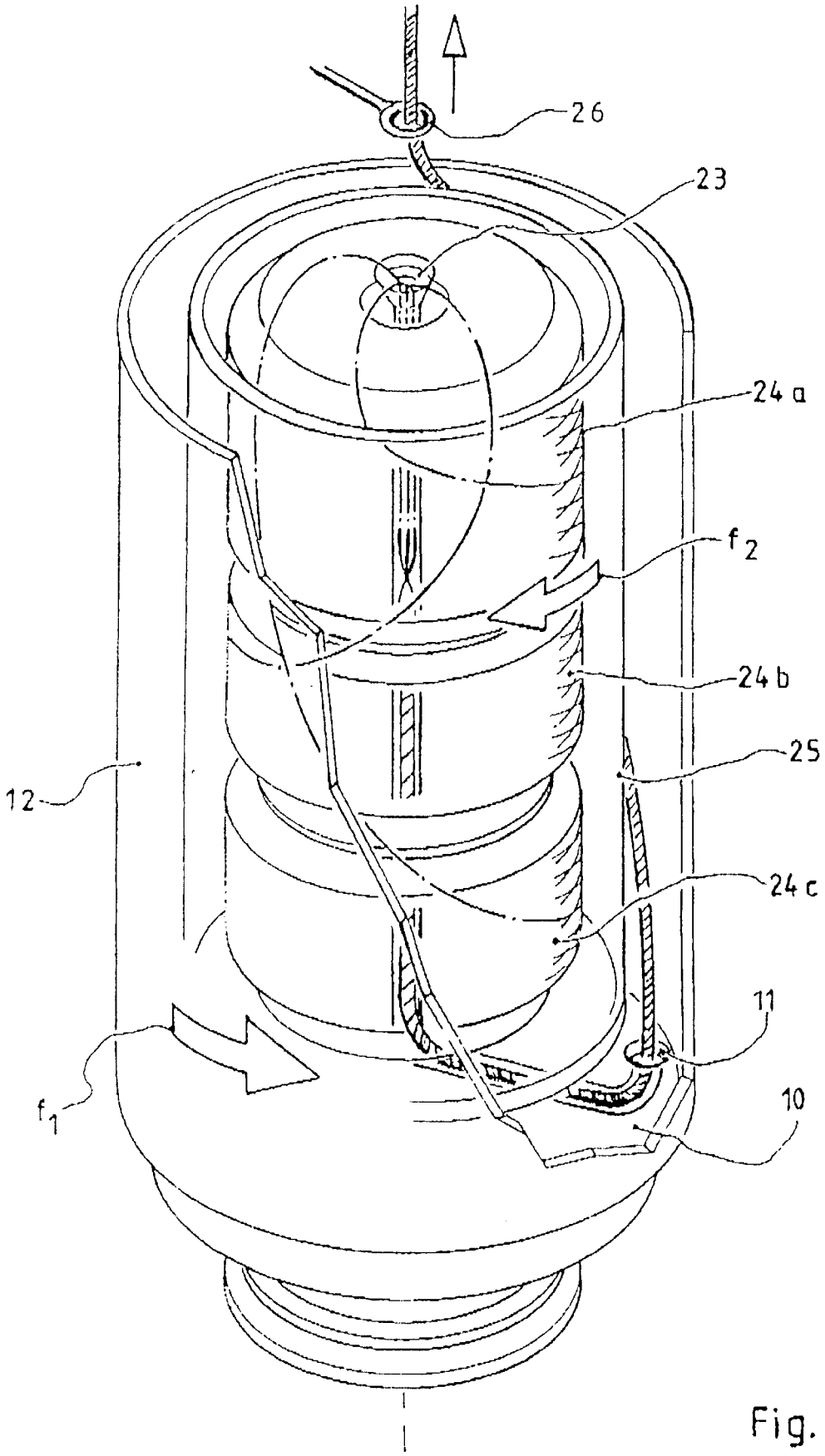
FIG. 2*a* shows the p and q removal directions of the individuals yarns.

FIG. 2*a* illustrates the p removal direction of the individual yarn removed from the supply bobbin 24*b* and the q removal direction of the individual yarns removed from the supply bobbins 24*a* and 24*c*.

Figure 3:
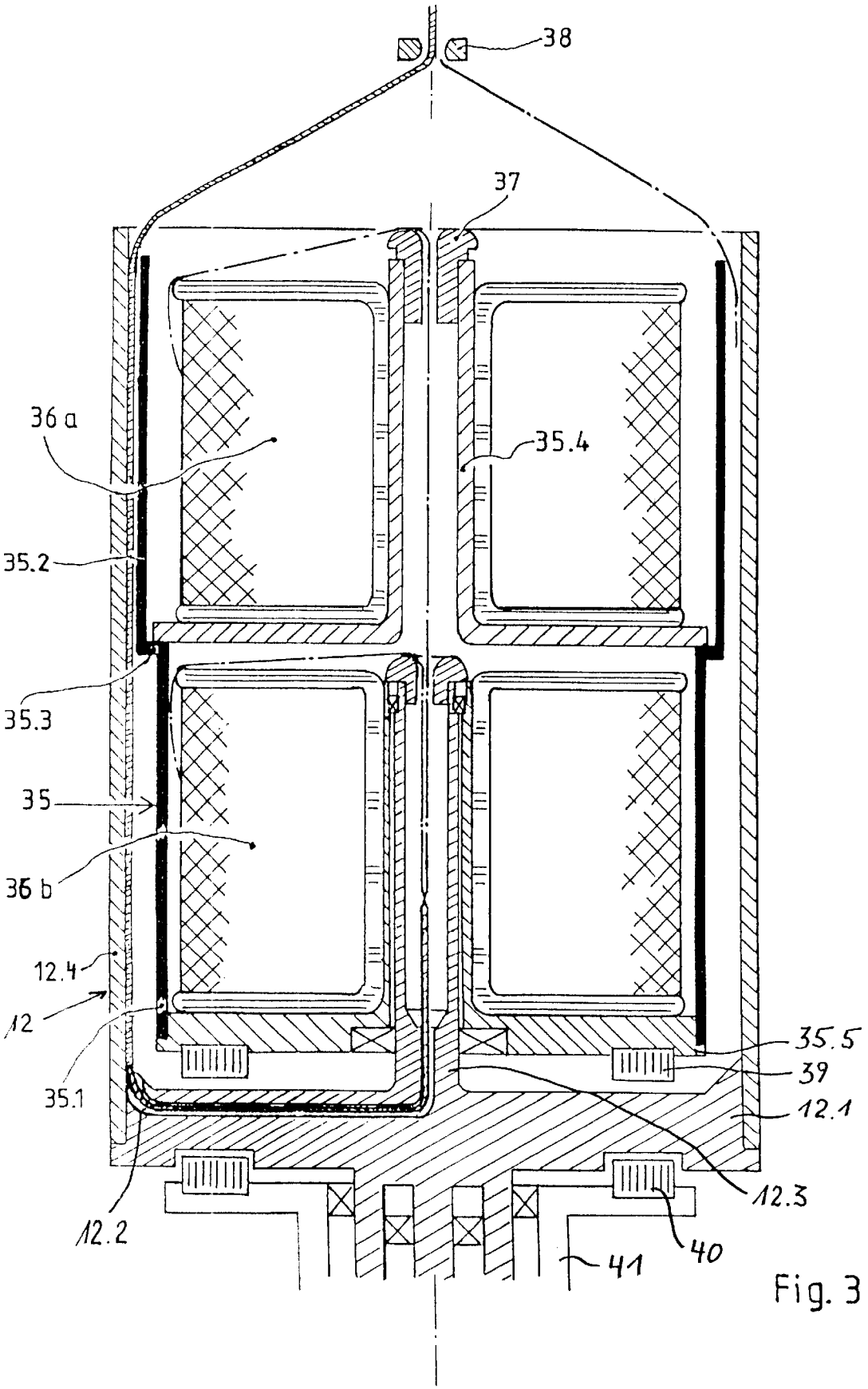
FIG. 3 shows in a schematic sectional view a portion of a three-for-one twisting spindle with divided hollow spindle axle and with a protective pot comprised of two portions of different diameters.

FIG. 3 shows a three-for-one twisting spindle with a rotatably driven twisting pot 12 comprising a twisting pot bottom 12.1 through which a radially extending yarn guide channel 12.2 extends, and further comprising a spindle hollow axle 12.3 connected to the inner end of the yarn guide channel 12.2 as well as a twisting pot mantle 12.4. The bobbin support 35 is rotatably supported on the spindle axle 12.3 and comprises a bottom 35.5 and a protective pot having a lower portion 35.1 of a smaller diameter than the upper portion 35.2 so that a radial support flange 35.3 results. In this manner, it is possible to position the supply bobbins 36*a* and 36*b* with axial spacing to one another whereby the upper supply bobbin 36*a* is placed onto a bobbin support element 35.4 supported on the support flange 35.3. Due to the arrangement of two separate hollow spindle axle parts, the individual spun yarn removed from the lower supply bobbin 35*b* can be introduced into the lower part of the hollow spindle axle while the yarn removed from the upper supply bobbin 36*a* can be introduced through the upper end of a yarn inlet 37 into the upper part of the hollow spindle axle.

The two individual spun yarns removed from the supply bobbins 36*a* and 36*b* are combined in the lower spindle hollow axle part and then are guided through the yarn guide channel 12.2 in the radial direction before they are guided along the inner wall of the mantle 12.4 of the twisting pot in the upper direction to the yarn guide 38 from where they are guided into a non-represented yarn winding device.

Magnets 39 are inserted into the bobbin support bottom 35.5 along a circular path and have arranged opposite thereto follower magnets 40 for a rotatory drive of the bobbin support. The counter magnets are inserted in a conventional manner into the driven rotatory part 41 of the three-for-one twisting spindle. These follower magnets 40 are polarized such that the rotatory part 41, rotating preferably counter to the twisting pot 12, drives in rotation the bobbin support 35.

For a fixed connection of the supply bobbins with the bobbin support, respectively, bobbin support protective pot in the embodiments according to FIGS. 2 and 3, non-represented pin connections or magnetic coupling can be provided.

The specification incorporates by reference the disclosure of German priority document 197 27 609.1 of Jun. 28, 1997.

The present invention is, of course, in no way restricted to the specific disclosure of the specification and drawings, but also encompasses any modifications within the scope of the appended claims.

What is claimed is:

1. An integrated doubling and twisting method comprising the steps of:

arranging at least two supply bobbins coaxially above one another in a protective pot of a bobbin support, wherein said bobbin support is surrounded by a balloon limiter and has a hollow spindle axle extending therethrough;

connecting said at least two supply bobbins to one another;

rotating said bobbin support together with said at least two supply bobbins and rotating said balloon limiter in opposite direction;

removing individual spun yarns from said at least two supply bobbins such that one of said individual spun yarns is removed in clockwise direction and another one of said individual spun yarns is removed in counterclockwise direction;

guiding said individual spun yarns together through said hollow spindle axle, a radially extending yarn guide channel, and a gap between said balloon limiter and said protective pot to a winding device.

* * * * *

UNITED STATES PATENT AND TRADEMARK OFFICE

CERTIFICATE OF CORRECTION

PATENT NO. : 6,021,631
DATED : 02/08/00
INVENTOR(S) : Michael Prechtel

It is certified that error appears in the above-identified patent and that said Letters Patent is hereby corrected as shown below:

On title page, item [75] should read as follows:

[75] Inventors:

Michael Prechtel, Konstanz, Germany

Signed and Sealed this

Ninth Day of January, 2001

*Attest:*

Q. TODD DICKINSON

*Attesting Officer*

*Commissioner of Patents and Trademarks*